US010327571B1

(12) United States Patent
Bradford

(10) Patent No.: US 10,327,571 B1
(45) Date of Patent: Jun. 25, 2019

(54) SUPPORT PLATE FOR A PICTURE FRAME

(71) Applicant: Richard N. Bradford, Lake Mary, FL (US)

(72) Inventor: Richard N. Bradford, Lake Mary, FL (US)

( * ) Notice: Subject to any disclaimer, the term of this patent is extended or adjusted under 35 U.S.C. 154(b) by 0 days.

(21) Appl. No.: 15/969,114

(22) Filed: May 2, 2018

(51) Int. Cl.
*A47G 1/16* (2006.01)
*A47G 1/14* (2006.01)

(52) U.S. Cl.
CPC ..... *A47G 1/143* (2013.01); *A47G 1/141* (2013.01)

(58) Field of Classification Search
CPC ..... A47G 1/141; A47G 1/143
USPC ..... 40/750, 754, 755; 248/456, 457, 465
See application file for complete search history.

(56) References Cited

U.S. PATENT DOCUMENTS 1,840,659 A * 1/1932 Eburne ..... A47G 1/143 248/456
2,003,824 A * 6/1935 Cavalero ..... A47G 1/143 40/746
2,926,441 A * 3/1960 Cross ..... B42D 5/043 248/459
4,622,767 A * 11/1986 Sullivan ..... A47G 1/143 248/463
5,068,987 A * 12/1991 Tontarelli ..... A47G 1/143 40/389
5,234,190 A * 8/1993 Cross ..... A47B 97/08 248/459
6,163,998 A * 12/2000 James ..... A47G 1/141 40/750
6,395,125 B1 5/2002 Bradford
6,402,878 B1 6/2002 Bradford
6,780,273 B1 8/2004 Bradford

* cited by examiner

*Primary Examiner* — Joanne Silbermann
(74) *Attorney, Agent, or Firm* — Terry M. Sanks, Esq.; Beusse Wolter Sanks & Maire, PLLC

(57) ABSTRACT

A photograph frame has a backing plate with an integrally formed support member that can be bent out of a plane of the backing plate to support the frame at a viewing angle. The support member incorporates an integral locking member that is bent out of a plane of the support member to maintain the support member in a fixed position. Both the support member and locking member are formed in situ with the backing plate.

18 Claims, 2 Drawing Sheets

SUPPORT PLATE FOR A PICTURE FRAME

BACKGROUND OF THE INVENTION

The present invention relates to picture frames and, more particularly, to a support plate for a picture frame.

In prior U.S. Pat. No. 6,780,273 (the '273 Patent), a process for making a picture frame having printed border artwork on a transparent front panel that has a separately attached rear support plate is described. The support plate is created by marking a cut path in a computer for cutting the picture frame support plate and then laser cutting or die cutting a foldout picture frame stand into the support plate and cutting the support plate along the marked cut path. The cut picture frame support plate is then attached to the cut transparent front panel. The picture frame support plate may be made of a paper board or plastic and have a fold-out picture frame stand formed therein to reduce the cost of the picture frame. While this support plate does function as a low-cost frame support for a picture frame, the fold-out stand is relatively weak and easily collapses allowing the frame to fall from an upright position. Accordingly, what is needed is a more robust stand to support the frame while maintaining a low-cost product.

SUMMARY OF THE INVENTION

A backing plate for a photograph frame comprises a generally flat molded plastic sheet shaped and sized to accommodate a selected style and size of photograph frame. An integral frame stand is defined by a first pair of spaced apart lines formed in the sheet and extending from a pair of spaced apart points in the sheet to one or more edges of the sheet. The lines cut through a thickness of the sheet to create a first plastic strip separated from the sheet by the lines, but attached to the sheet at one end. A thinned linear area is defined between the pair of points at the end of the strip attached to the sheet so as to create a plastic hinge such that the first strip can be bent at an angle out of the plane of the plastic sheet. A second plastic strip is created within the first plastic strip by another pair of lines extending at a first end from a pair of spaced apart points on the first plastic strip. A second end of each of these latter pair of lines terminates in a connecting line extending partially across the first plastic strip thereby forming an end of the second strip. A thinned linear area is defined between the another pair of points such that the second plastic strip can be bent at an angle out of the plane of the plastic strip. At least one groove is formed in the plastic sheet adjacent the first strip in a location such that the second strip can be bent out of a plane of the first plastic strip and the end of the second plastic strip can be placed in the groove to support the first plastic strip at a predetermined angular orientation with respect to the plastic sheet to form a support for the backing plate.

In one embodiment, the backing plate is cut such that the first pair of lines define a generally hour-glass shape of the first strip such that the first strip has a narrow width portion between a pair of wider width upper and lower sections. The thinned linear area between the another pair of spaced apart points on the first plastic strip extends partially across the narrow width portion of the first plastic strip. The second plastic strip has an end at the connecting line that is wider than the narrow width portion of the first plastic strip. The at least one groove is formed in the plastic sheet adjacent the narrow width portion of the first plastic strip. The wider end of the second plastic strip is wide enough to engage the groove so as to trap the second plastic strip between the groove and the first plastic strip to thereby hold the first plastic strip in an angular orientation with respect to the plastic sheet. The first plastic strip is thereby formed to support the plastic sheet in an angular presentation position.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered to be limiting of its scope, the embodiments will be described and explained with additional specificity and detail through the use of the accompanying drawings in which.

DETAILED DESCRIPTION

Figure 1:
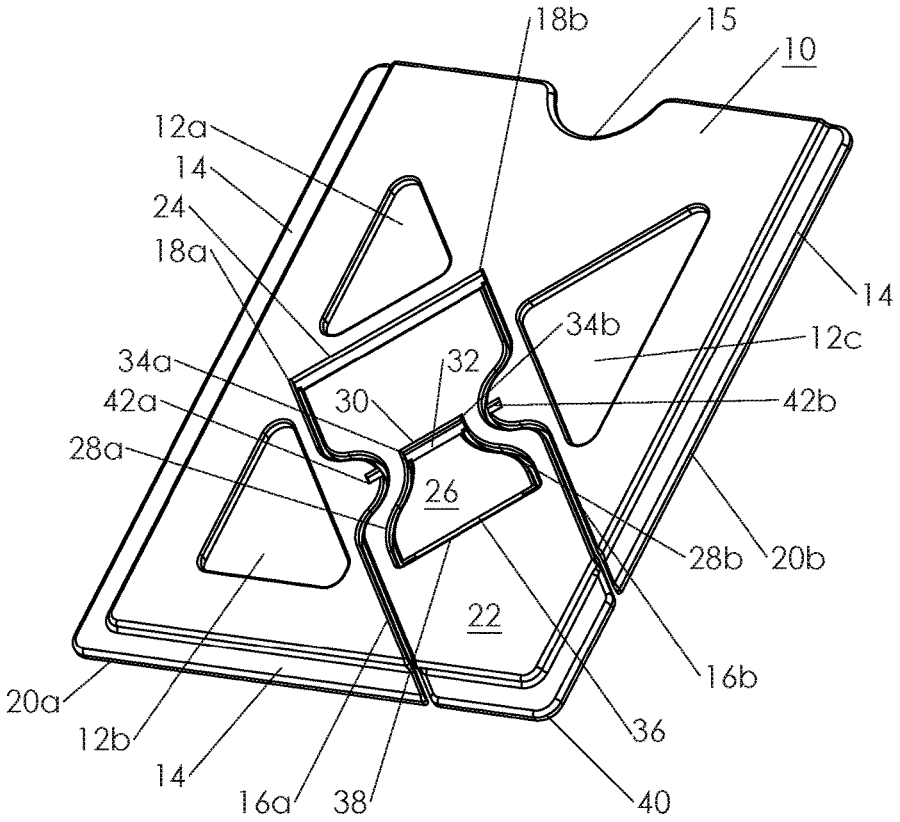
FIG. 1 is a perspective view of a substantially flat plastic sheet that has been formed with cut-lines to create an integral support stand for a photographic frame support.

Embodiments are described herein with reference to the attached figures wherein like reference numerals are used throughout the figures to designate similar or equivalent elements. The figures are not drawn to scale and they are provided merely to illustrate aspects disclosed herein. Several disclosed aspects are described below with reference to non-limiting example applications for illustration. It should be understood that numerous specific details, relationships and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. The embodiments are not limited by the illustrated ordering of acts or events, as some acts may occur in different orders and/or concurrently with other acts or events. Furthermore, not all illustrated acts or events are required to implement a methodology in accordance with the embodiments.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

Figure 2:
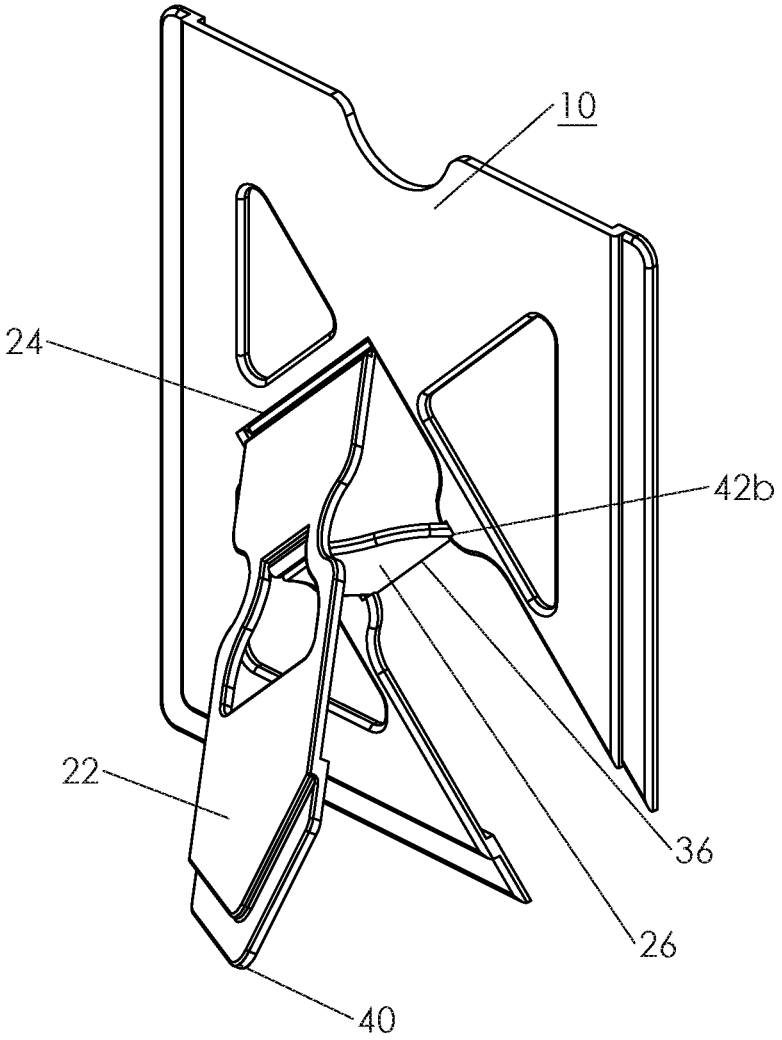
FIG. 2 is a perspective view of the sheet of FIG. 1 with the support stand raised into a support position.

Referring to the drawings, FIGS. 1 and 2 concurrently, a substantially flat sheet 10 is shown with various cutouts and cut-lines. This sheet is used as a backing plate for a photographic frame of the type described in the '273 Patent, the disclosure of which is hereby incorporated by reference. In the example described herein, the sheet is about 3 ½ inches by about 4 ½ inches although the design can be employed in any typical sized photograph frame. The sheet 10 may be formed of many different types of materials suitable for use as backing sheets for photograph frames such as, for example, compressed card stock or various types of plastic polymers, but in a preferred embodiment, the selected material for the sheet 10 is a high impact polystyrene material that is commercially available for plastic injection molding. For injection molding of the sheet 10, the mold is formed with selected cutouts 12*a*, 12*b* and 12*c*. These cutouts suffice to reduce the volume of material needed to mold the sheet and therefore reduce the cost of manufacturing. Three sides of the sheet 10 are formed with a border or strip-like area 14 that is, in the illustrated embodiment, depressed away from a primary plane of the sheet 10 and serves, in one function, to strengthen the sheet and, in another function, to space the sheet away from a front portion of a frame (not shown) so as to allow space for insertion of a photograph between the backing sheet and the frame front of the type shown in the aforementioned '273 Patent.

It should be noted that a typical thickness of material for the sheet 10 is about 1.5 MM or 1/16 inch and the border 14 is desirable in order to minimize bending of the sheet. Furthermore, the offset border 14 also functions as the contact area between the backing sheet 10 and a front decorative support plate of the type described in the '273 Patent so as to create the space between the backing sheet and the front support plate for insertion of a photograph. When the backing sheet and front support plate are assembled, typically by gluing, a photograph can be inserted from the edge of the backing sheet where the border 14 is omitted. A cutout 15 is formed along the edge of the sheet 10 which does not have a border 14 so that a photograph may be grasped in order to remove it from the frame assembly.

In the exemplary embodiment, a first pair of spaced apart cut lines 16*a* and 16*b* are formed or die cut in sheet 10 and extend from a pair of spaced apart points 18*a*, 18*b*, respectively. The lines 16*a*, 16*b* cut through the thickness of the sheet 10 and extend from the points 18*a*, 18*b* through edges 20*a* and 20*b* of the sheet to define a first plastic strip 22 separated from the sheet by the lines, which strip becomes the stand for supporting the plastic sheet 10 in an upright position. A thinned linear area or groove 24 is formed between the pair of points 18*a*, 18*b* to create a plastic hinge such that the first strip 22 can be bent at an angle out of the plane of the plastic sheet 10. It will be noted that the strip 22 is positioned such that a distal end is defined by the edges 20*a* and 20*b* so that a portion of the distal end is parallel to edge 20*a* and another portion is parallel is edge 20*b*. This design allows the strip 22 to function as a support for orienting the sheet in either a sideways or upright position. The strip 22 could also be formed such that it intersects only one edge of the sheet 10, but that would limit the orientation of the photograph frame to one position when supported by the strip 22.

A second plastic strip 26 is defined within the first plastic strip 22 by another pair of cut-through lines 28*a*, 28*b* extending from a first end 30. The strip 26 is preferably oriented to run concurrently with the first strip 22. The end 30 is established by a thinned area or groove 32 extending between a pair of spaced apart points 34*a*, 34*b* on the first plastic strip 22. A second or distal end 36 of the second plastic strip 26 is defined by a cut-through line 38 extending partially across the first plastic strip. This arrangement allows the second plastic strip 26 to be bent out of the plane of the first plastic strip 22.

It can be seen that the lines 16*a*, 16*b* are cut such that the first strip has a generally hour glass shape defined by a narrow section located at about 1/3 of the distance between the groove 24 and an outer end 40 of the strip. The groove 32 establishing the first end 30 of the second plastic strip 26 is located at the narrowest point between the lines 16*a*, 16*b*. The second plastic strip 26 is shaped by the lines 28*a*, 28*b* to be wider at the distal end 36 than the width of the first strip 22 at the groove 32 such that when the strip 26 is bent out of the plane of the first plastic strip 22, edges of the end 36 will abut against the sheet 10 outside the first plastic strip 22. As best seen in FIG. 1, there are two truncated grooves 42*a*, 42*b* extending into the sheet 10 and aligned with the groove 32.

Referring to FIG. 2, the first strip 22 is shown bent out of the plane of the sheet 10 to create a support stand for the backing plate or sheet. The strip 22 is maintained in the extended position by the second strip 26 being bent back out of the plane of the first strip 22 with the outer edges of the distal end 36 positioned in the grooves 42*a*, 42*b* to thereby lock the strip 26 in position. As will be appreciated, the plastic memory inherent in the plastic material of the sheet 10 will cause the strip 22 to be biased toward its initial position in the plane of the sheet thereby pressing the strip 26 toward the sheet 10 so that it is maintained in contact with the grooves 42*a*, 42*b* and keeping the strip 22 in a supporting position for the photographic frame. It can also be seen that the frame can be supported by the strip 22 with either the edge 20*a* being at a bottom of the frame in a display position or with the edge 20*b* being at a bottom of the frame in another display position.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising." Moreover, unless specifically stated, any use of the terms first, second, etc., does not denote any order or importance, but rather the terms first, second, etc., are used to distinguish one element from another.

Unless otherwise defined, all terms (including technical and scientific terms) used herein have the same meaning as commonly understood by one of ordinary skill in the art to which embodiments of the invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

While various disclosed embodiments have been described above, it should be understood that they have been presented by way of example only, and not limitation. Numerous changes, omissions and/or additions to the subject matter disclosed herein can be made in accordance with the embodiments disclosed herein without departing from the spirit or scope of the embodiments. Also, equivalents may be substituted for elements thereof without departing from the spirit and scope of the embodiments. In addition, while a particular feature may have been disclosed with respect to only one of several implementations, such feature may be combined with one or more other features of the other implementations as may be desired and advantageous for any given or particular application. Furthermore, many modifications may be made to adapt a particular situation or material to the teachings of the embodiments without departing from the scope thereof.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present disclosure in any way.

Therefore, the breadth and scope of the subject matter provided herein should not be limited by any of the above explicitly described embodiments. Rather, the scope of the embodiments should be defined in accordance with the following claims and their equivalents.

The invention claimed is:

1. A backing plate for a photograph frame comprising:

a generally flat molded plastic sheet having a thickness;

a first pair of spaced apart cut lines formed in said sheet and extending from a first pair of spaced apart points in said sheet to at least one edge thereof, each of the cut lines cutting through the thickness thickness of the sheet to define a first plastic strip being separated from the sheet along the first pair of spaced apart cut lines;

a first thinned linear area defined between said first pair of points to create a plastic hinge such that said first strip being configured to bend at an angle out of the plane of the plastic sheet;

a second plastic strip defined within the first plastic strip by another pair of cut lines extending at a first end from another pair of spaced apart points on said first plastic strip, a second end of each of said another pair of cut lines terminating in a connecting line extending partially across said first plastic strip thereby forming a strip end of said second strip;

a second thinned linear area defined between said another pair of points such that said second plastic strip is configured to bend at an angle out of the plane of the first plastic strip; and at least one groove formed in said plastic sheet adjacent said first strip in a location whereby the strip end of the second plastic strip when placed in the at least one groove supports the first plastic strip at a predetermined angular orientation with respect to the plastic sheet to form a support for the frame and wherein the first pair of cut lines define a generally hour-glass shape of said first strip such that said first strip has a narrow width portion between a pair of wider width upper and lower sections, said second thinned linear area between said another pair of spaced apart points on said first plastic strip extending partially across said narrow width portion of said first plastic strip, and said second plastic strip having a wider end at said connecting line that is wider than the narrow width portion of said first plastic strip, said at least one groove being formed in said plastic sheet adjacent said narrow width portion of said first plastic strip, and said wider end of said second plastic strip being wide enough to engage said at least one groove.

2. The backing plate of claim 1, wherein the at least one edge comprises two intersecting edges, one of the first pair of cut lines terminates in a first edge of the two intersecting edges of the sheet and another of the first pair of cut lines terminates in a second edge of the two intersecting edges of the sheet such that an outer end of the first strip encompasses a corner of the sheet.

3. The backing plate of claim 2, wherein the outer end of the first strip defined by the first and second edges of the sheet being configured to support the sheet by the first strip with either of the first and second edges forming a base of the sheet.

4. The backing plate of claim 1, and including a border formed along at least three sides of the sheet and depressed away from a primary plane of the sheet such that the sheet can be supported in a spaced apart relationship to a generally flat surface to which the sheet is attached.

5. A backing plate for a photograph frame comprising:

a generally flat rigid sheet having a thickness;

a first pair of spaced apart cut lines formed in said sheet diagonally and extending from a first pair of spaced apart points in said sheet to two intersecting edges thereof, each of the cut lines cutting through the thickness of the sheet to define a first strip separable from the sheet along the first pair of spaced apart cut lines;

a first thinned linear area defined between said first pair of points to create a living hinge about which said first strip bends at an angle out of the plane of and separates from the sheet;

a second strip defined within the first strip by another pair of spaced apart cut lines extending at a first end from another pair of spaced apart points on said first strip, a second end of each of said another pair of cut lines terminating in a connecting line extending partially across said first strip thereby forming a strip end of said second strip;

a second thinned linear area defining another living hinge between another pair of spaced part points such that said second strip is configured to bend at an angle out of the plane of the first strip about said another living hinge; and at least one groove formed in said sheet adjacent said first strip in a location whereby the strip end of the second strip when placed in the at least one groove supports the first strip at a predetermined angular orientation with respect to the plane of the sheet to form a support for the photograph frame in either of a sideways position and an upright position.

6. The backing plate of claim 5, wherein the first pair of cut lines define a generally hour-glass shape of said first strip such that said first strip has a narrow width portion between a pair of wider width upper and lower sections, said second thinned linear area between said another pair of spaced apart points on said first strip extending partially across said narrow width portion of said first strip, and said second strip having a wider end at said connecting line that is wider than the narrow width portion of said first strip, said at least one groove being formed in said sheet adjacent said narrow width portion of said first strip, and said wider end of said second strip being wide enough to engage said groove.

7. The backing plate of claim 6, wherein said sheet is formed of card stock.

8. The backing plate of claim 6, wherein said sheet is formed of high impact polystyrene.

9. The backing plate of claim 6, and including a plurality of cutouts formed in said sheet to reduce the volume of material in said sheet.

10. The backing plate of claim 6, and including a border formed along at least three sides of the sheet and depressed away from a primary plane of the sheet such that the sheet can be supported in a spaced apart relationship to a generally flat surface to which the sheet is attached.

11. The backing plate of claim 10, wherein the border is offset from the plane of the sheet by an amount generally equal to the thickness of the sheet.

12. The backing plate of claim 5, wherein the sheet has a generally rectangular shape and the first pair of spaced apart cut lines extend from an inner area of said sheet diagonally toward the two intersecting edges of the sheet.

13. The backing plate of claim 12, wherein one of the first pair of cut lines terminates in a first edge of the two intersecting edges of the sheet and another of the first pair of cut lines terminates in a second edge of the two intersecting edges of the sheet such that an outer end of the first strip encompasses a corner of the sheet.

14. The backing plate of claim 13, wherein the outer end of the first strip defined by the two intersecting edges of the sheet being configured to support the sheet by the first strip with either of the two intersecting edges forming a base of the sheet.

15. A backing plate for a photograph frame comprising:

a generally flat molded plastic sheet having a thickness and a plurality of corners;

a first pair of spaced apart cut lines formed in said sheet and extending from a first pair of spaced apart points in said sheet to first and second edges of the sheet, each of the cut lines cutting through the thickness of the sheet to define a first plastic strip being separated from the sheet along the first pair of spaced apart cut lines wherein an outer end of the first strip encompasses a corner of the plurality of corners and either of the first and second edges forming a base of the sheet;

a first thinned linear area defined between said first pair of points to create a plastic hinge such that said first strip is configured to bend at an angle out of the plane of the plastic sheet leaving a separation between the first pair of spaced apart cut lines;

a second plastic strip defined within the first plastic strip by another pair of cut lines extending at a first end from another pair of spaced apart points on said first plastic strip, a second end of each of said another pair of cut lines terminating in a connecting line extending partially across said first plastic strip thereby forming a strip end of said second strip;

a second thinned linear area defined between said another pair of points such that said second plastic strip is configured to bend at an angle out of the plane of the first plastic strip; and at least one groove formed in said plastic sheet adjacent said first strip in a location whereby the strip end of the second plastic strip when placed in the groove supports the first plastic strip at a predetermined angular orientation with respect to the plastic sheet to form a support for the frame.

16. The backing plate of claim 15, wherein an outer end of the first strip is defined by the corner of the sheet such that the sheet can be supported by the first strip with either of the first and second edges forming the base of the sheet.

17. The backing plate of claim 15, wherein the sheet has a generally rectangular shape and the first pair of spaced apart cut lines extend from an inner area of said sheet diagonally toward the first and second edges of the sheet.

18. The backing plate of claim 15, wherein the first pair of spaced apart cut lines define a generally hour-glass shape of said first strip such that said first strip has a narrow width portion between a pair of wider width upper and lower sections, said second thinned linear area between said another pair of spaced apart points on said first strip extending partially across said narrow width portion of said first strip, and said second strip having a wider end at said connecting line that is wider than the narrow width portion of said first strip, said at least one groove being formed in said sheet adjacent said narrow width portion of said first strip, and said wider end of said second strip being wide enough to engage said at least one groove.

* * * * *